United States Patent [19]

Bahr, deceased et al.

[11] Patent Number: 4,869,383

[45] Date of Patent: Sep. 26, 1989

[54] CONTAINER CLOSURE WITH PULL TAB

[76] Inventors: Chester H. Bahr, deceased, late of Sheboygen; by Carol G. Bahr, executrix, 4427 Najacht Rd., Sheboygan, both of Wis. 53083

[21] Appl. No.: 254,523

[22] Filed: Oct. 6, 1988

[51] Int. Cl.[4] ..... B65D 51/00

[52] U.S. Cl. ..... 215/232; 215/305

[58] Field of Search ..... 215/232, 305; 220/359; 229/123.1

[56] References Cited

U.S. PATENT DOCUMENTS

| | | | |
|---|---|---|---|
| 1,473,280 | 11/1923 | Clark . | |
| 2,701,078 | 2/1955 | Bowman | 222/117 |
| 3,163,310 | 12/1964 | Blakslee . | |
| 3,655,084 | 4/1972 | Wilhaus | 215/1 C X |
| 4,131,211 | 12/1978 | Corbic | 215/232 X |
| 4,209,126 | 6/1980 | Elias | 215/232 X |
| 4,318,490 | 3/1982 | Schneider | 220/359 X |
| 4,423,819 | 1/1984 | Cummings | 215/232 |
| 4,522,332 | 6/1985 | Munk | 229/123.1 X |
| 4,524,866 | 6/1985 | Pollacco | 206/223 |
| 4,754,890 | 7/1988 | Ullman et al. | 215/232 |

*Primary Examiner*—Donald F. Norton

*Attorney, Agent, or Firm*—Francis J. Bouda

[57] ABSTRACT

The container closure of the present invention is particularly useful for dispensing automobile engine oil from an inverted bottle or container where all of the fluid is normally emptied at one time. The opening in the container has a peelable, flexible seal which may be disposed beneath the normal cap or cover of the container. The seal has an elongated pull-tap which doubles back across the outer face of the seal and extends upwardly along the side of the container so that the end thereof may be grasped after the container is inverted and before the contents are discharged. When the end of the tab is pulled, the closure is peeled away from the container-opening, and the contents can be discharged without spilling.

4 Claims, 1 Drawing Sheet

CONTAINER CLOSURE WITH PULL TAB

BACKGROUND OF THE INVENTION

One of the difficulties of pouring fluid from a container, such as a can or a bottle, into a relatively small opening is that much of the fluid is spilled or lost while "aiming" the flowing contents into the small-diameter opening. This is particularly true of the oil filler tubes for motor oil in an automobile where a quart of motor oil must be emptied from the bottle or can into a tube of approximately 1 inch in diameter. Much spilling and wastage occurs, and many attempts have been made to solve the problem.

As is well-known, a tubular extension or spout is often used by gasoline-station attendants for the dispensing of can-packaged motor oil. This spout has a sharp, pointed end which penetrates the can and provides an elongated, small-diameter pouring tube, which is easily aimed at and inserted into the upper-end of the oil-filler tube on the automobile.

More recently automobile engine oil has been package in bottles having an elongated neck which fits into the filler-tube. This elongated neck is usually much shorter than the above-mentioned spout for can-type packaging.

In each case, however, the container has to be opened while in an upright position, and then inverted quickly and with great dexterity so that the oil pours from the spout into the filler-tube and not on the outside thereof.

Several attempts have been made to solve this problem; notably the dispensing cap disclosed in Bowman U.S. Pat. No. 2,701,078 which was granted on Feb. 1, 1955. This mechanical device has a latch-type arrangement which is a part of the dispensing cap and which, with a spring-loaded finger to engage the upper-end of the oil tube to provide an opening in the dispensing cap after it has been inserted into the filler tube. This mechanical device is fairly complicated and expensive and must be placed on the fluid container prior to use and removed after the contents have been dispensed. Nevertheless, this is probably the only dispenser in the prior art which enables the container to be opened while handling an inverted fluid container at its upper end.

The Cummings U.S. Pat. No. 4,423,819 issued on Jan. 3, 1984 illustrates a closer for a fluid container, such as a bottle for intravenous fluid or liquid for medical purposes. However, in this instance, a dispensing spout of the inverted container is available for manual manipulation after being inverted because the spout does not reside within a narrow tube of the receiving container.

Pollacco U.S. Pat. No. 4,524,866 shows how the contents of a fluid container can be removed, but in this invention the receiving container must have a puncture device operable beneath the dispensing unit, an arrangement not possible when adding oil to an automobile engine.

The present invention is particularly directed to a flexible seal of a type similar to that which often appears as the safety, tamper-evident secondary closure on medicine bottles, milk bottles, and other fluid containers. This type of tamper-evident seal is illustrated in Elias U.S. Pat. No. 4,209,126 issued June 24, 1980; Corbic U.S. Pat. 4,131,211 issued Dec. 26, 1978; Willhaus U.S. Pat. No. 3,655,084 issued April 11, 1972; Blakslee U.S. Pat. No. 3,163,310 issued Dec. 29, 1964 and Clark U.S. Pat. No. 1,473,280 issued Nov. 6, 1923.

However, in all of the patents just referred to above, removal of the tamper-evident seal or opening the container must be done while the bottle or container is in an upright position, or else the fluid or the contents will be uncontrollably discharged.

The prior art all fails, however, to teach how the container may be opened after the neck of the container is inserted into a narrow, pipe-like tube, while the container is inverted and held above the tube into which the contents are to be poured.

OBJECTS OF THE INVENTION

It is therefore a principal object of the present invention to provide a fluid container having a neck which can be inserted into a narrow receptor and wherein the closer at the end of the neck can be removed or opened after insertion of the neck into the upper end of the receptor.

A further object of the present invention is to provide an inexpensive seal, for an automobile lubricating oil container, which can be opened after insertion into the filler-pipe of the automobile, without wasting or spilling the contents.

Still another object of the present invention is to provide a tamper-evident seal with an opening having a necked container, said seal having an elongated pull-tab which is operable from the end of the container opposite to the discharge opening.

SUMMARY OF THE INVENTION

In the present invention, a disc made of paper or foil or the like, having an adhesive on one side is provided for closing the opening at the tubular neck of a fluid container. The adhesive may be induction-coil-activated, and in this case is similar to the tamper-evident seals on milk bottles, medicine bottles, and the like. However, the pull-tab on the disc of the present invention is elongated and extends along the neck of the container toward the closed end thereof, where it is held in place during the marketing and storage thereof.

When it is desired to discharge the contents into an automobile engine or the like, the principal cover or cap of the bottle is removed, the elongated pull-tab is double-back across the face of the seal, the bottle inverted, and the neck inserted into the oil tube of the automobile. Thereafter the end of the tab is pulled which causes the disc to peel away from the bottle-opening within the oil tube of the automobile, and thus all of the fluid in the bottle is discharged in the intended place and for the intended purpose, all without waste or spillage or soiling of the operator's hands.

With the above and other objects in view, further information and a better understanding of the present invention may be achieved by referring to the following detailed description:

DETAILED DESCRIPTION

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts:

Figure 1:
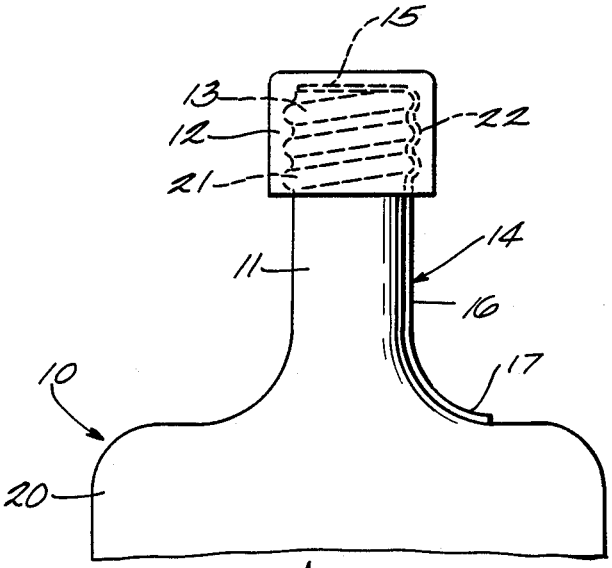
FIG. 1 is a fragmentary, vertical elevational view of a typical plastic 1-quart oil container with the present invention affixed thereto.
Figure 4:
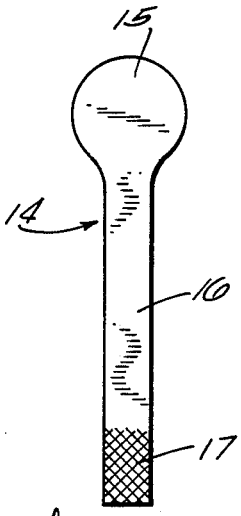
FIG. 4 is a top plan view of one form of the closer of the present invention.

The container 10 is a generally bottle-like container having a neck 11 and a cap 12 and is often used for dispensing motor-engine oil and the like.

The cap 12 is screw-threaded by removable from the upper- end 13 of the neck 11 to expose the closer 14 of the present invention.

The generally circular or disc-like end 15 of the closer 14 has a dimension appropriate to the periphery of the upper end 13 of the container 10, but also includes a pull-tab 16, of length appropriate for gripping, after it has been double-back over the neck 13, and terminating in a finger-grip area 17.

Figure 2:
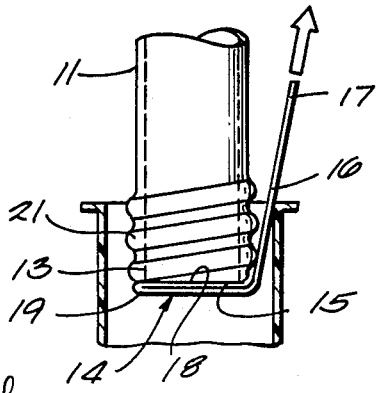
FIG. 2 illustrates how the oil container is inserted into the oil fill hole or tube where the contents are to be received, after the cap of the container has been removed, but before the closer of the present invention is activated.

One side of the closer may have a heat-activated or induction-coil-activated adhesive which is activated after the container 10 has been filled, and which permits the closer end 15 to be in removable but fluid-tight sealing engagement with the upper end of the spout 13, as is shown at 18 in FIG. 2.

Referring also to FIG. 2, it can be seen that the pull-tab 16 is doubled back across the face of the disc portion 15, as at 19 in FIG. 2, with the elongated end 16 extending upwardly along the neck 11 and the body- portion 20 of the container 10.

The pull-tab 16 may be releasably secured to the outside of the container at the neck 11 and body 20, as by a pressure-sensitive adhesive, so that it does not "flap" loose before the bottle is to be emptied.

As can be seen in FIG. 2, the threads 21 on the upper end 13 are molded in such a way as to provide a slight indentation, groove, or passage-way 22 in which the tab 16 may lie when the cap 12 is secured by the threads 21 at the top of the bottle.

Figure 3:
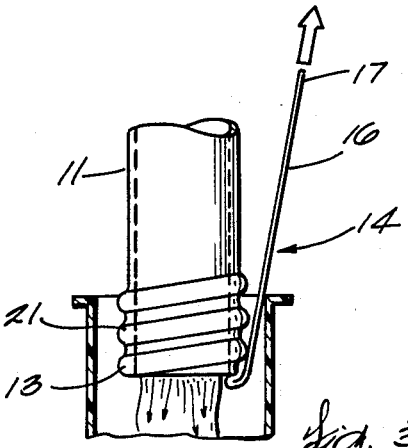
FIG. 3 is a view similar to that of FIG. 2 illustrating how the closer of the present invention is peeled back to expose the opening and the fluid discharged therefrom.
Figure 5:
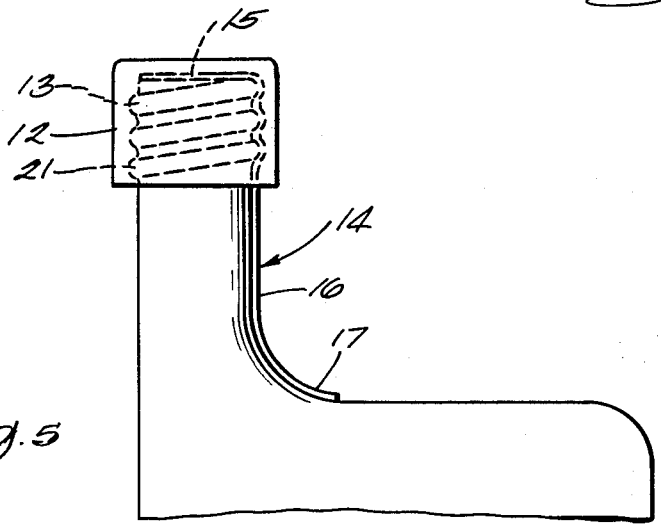
FIG. 5 is a view similar to FIG. 1 but illustrating a popular style of semi-rectangular plastic bottle used by many oil companies.

As is shown in FIG. 3, pulling on the finger-grip area 17 disengages the pull-tab 26 from the body 20 and neck 11 of the container, and continued pulling thereon causes the circular disc portion 15 to be peeled away (overcoming the resistance of the adhesive) so that the fluid contents of the container 10 may be discharged into the oil-fill tube of the automobile engine.

It is to be understood that the container 10 may be supplied with the pull tab 26 extending up the side of the container co-extensive with the disc 15 (in which case the user must double-back the tab across the face of the disc after removing the cap 12), or it can be supplied with the tab pre-folded and double-back (under the cap).

Thus it is clearly seen that the protective cap 12 of the bottle 10 may be removed and the bottle inverted without spilling the contents. It is then inserted into the oil-fill tube of the automobile engine, the closer 14 peeled away from the open end 13 of the neck 11, and the fluid discharged into the oil-fill tube, all without any need for the operator to soil his hands or, in fact, to touch the spout end of the container or, more importantly without spilling or messing up the surroundings in trying to insert the spout of the oil container into the oil-fill tube after the bottle is opened.

Having thus described my invention, what I claim as new and desire to protect by Letter Patent are the following:

1. A container and a closure for said container, said container having a closed end, an elongated neck and a dispenser opening at the end of said neck, said closure having a first portion disposed across said opening in a fluid-tight manner, said closure having a tab portion integral with said first portion and joined thereto along a fold line, said tab portion being foldable about said fold line so that it can overlie the first portion and extend beyond said first portion and said opening at a sufficient distance along the side of said elongated neck whereby the tab portion may be manually grasped at said distance from the opening while the container is inverted.

2. The container and closure of claim 1, wherein said tab portion is longer than the said first portion.

3. The container and closure of claim 1, wherein said tab portion has a major and a minor dimension, the major dimension being greater than the opening at the end of the said neck of said container.

4. The container and closure of claim 1, wherein said tab portion is long enough so that after being folded about said fold line and overlying said first portion, it extends a distance far enough along the side of the neck of said container so that the end thereof may be grasped and pulled toward the closed end of said container while said container is inverted, whereby to peel the first portion away from said dispenser opening and permit the discharge of the contents of said container, while said container is in an inverted position.

* * * * *